US005190566A

United States Patent [19]

Sparks et al.

[11] Patent Number: 5,190,566

[45] Date of Patent: Mar. 2, 1993

[54] INCORPORATION OF A COPROCESSING ADDITIVE INTO COAL/OIL AGGLOMERATES

[75] Inventors: Bryan D. Sparks, Gloucester; Richard D. Coleman, Orleans; Floyd N. Toll, Russell; F. Weldon Meadus, Ottawa; Michio Ikura, Kanata, all of Canada

[73] Assignee: Energy, Mines and Resources Canada, Ottawa, Canada

[21] Appl. No.: 818,100

[22] Filed: Jan. 8, 1992

[51] Int. Cl.[5] ..... C10L 9/10; C10L 9/00

[52] U.S. Cl. ..... 44/627; 44/621; 44/623

[58] Field of Search ..... 44/627, 621

[56] References Cited

U.S. PATENT DOCUMENTS

| | | | |
|---|---|---|---|
| 1,990,948 | 2/1935 | Loghry | 44/20 |
| 4,171,957 | 10/1979 | Moriyama et al. | 44/51 |
| 4,175,924 | 11/1979 | Kindig et al. | 44/15 |
| 4,249,910 | 2/1981 | Masologites et al. | 44/1 SR |
| 4,284,413 | 8/1981 | Capes et al. | 44/627 |
| 4,396,396 | 8/1983 | Mainwaring | 44/627 |
| 4,448,585 | 5/1984 | Yoo | 44/51 |
| 4,741,278 | 5/1988 | Franke et al. | 110/342 |

FOREIGN PATENT DOCUMENTS

| | | | |
|---|---|---|---|
| 1144500 | 4/1983 | Canada | 44/627 |

*Primary Examiner*—Ellen McAvoy

[57] ABSTRACT

In the present invention, iron sulfate is added in the form of an aqueous wash solution to coal agglomerates after separation of ash from the agglomerated coal. As the agglomerates remain in a continuous water phase, a good dispersion of the iron sulfate solution throughout the agglomerate matrix occurs. At this stage an unexpectedly strong adsorption of Fe ions onto the coal surfaces occurs without any adverse effects on agglomerate integrity and the ability to separate it selectively by floatation. Furthermore, this good dispersion also results in over 94% of the iron sulfate in the wash solution being transferred to the agglomerates. This manner of addition of iron sulphate to coal has been shown to elevate advantageously the lowest temperature at which coke formation occurs during coprocessing.

7 Claims, 2 Drawing Sheets

ADSORPTION OF Fe(II) BY AGGLOMERATED BATTLE RIVER COAL

ADSORPTION OF ADDITIVE BASED ON AMOUNT ADDED.

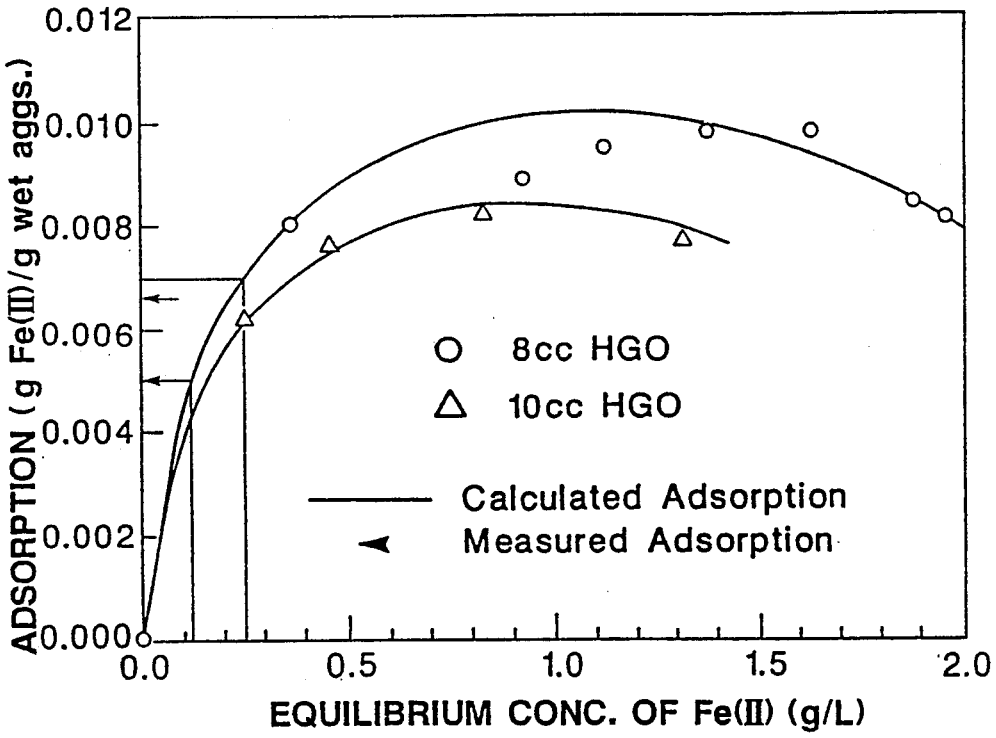
FIG. 1 ADSORPTION OF Fe(II) BY AGGLOMERATED BATTLE RIVER COAL
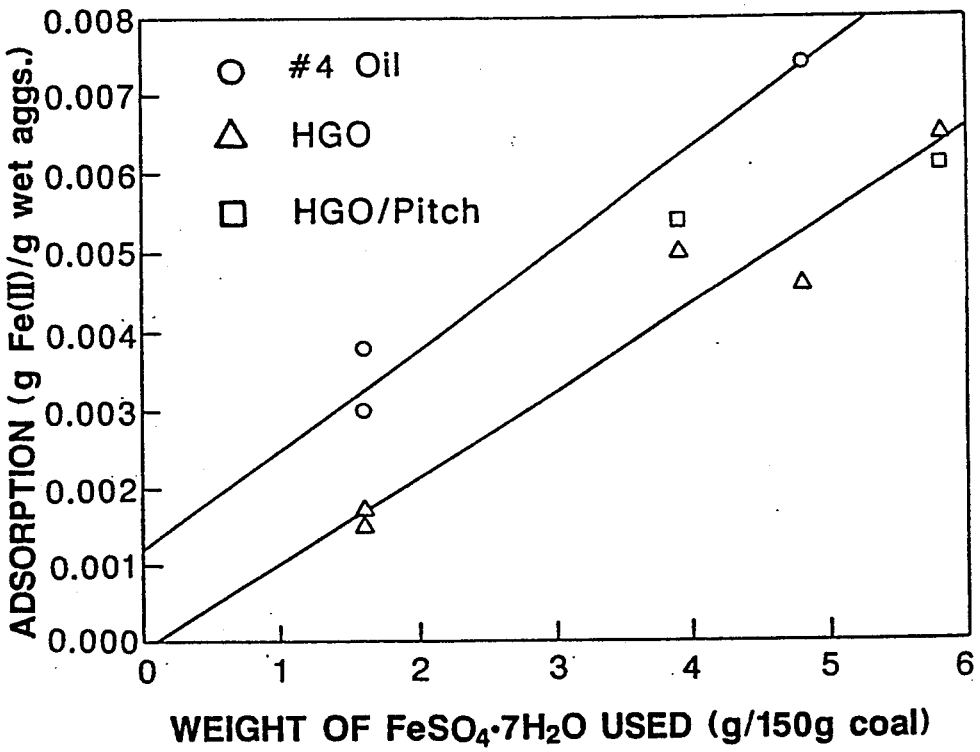
FIG. 2 ADSORPTION OF ADDITIVE BASED ON AMOUNT ADDED.

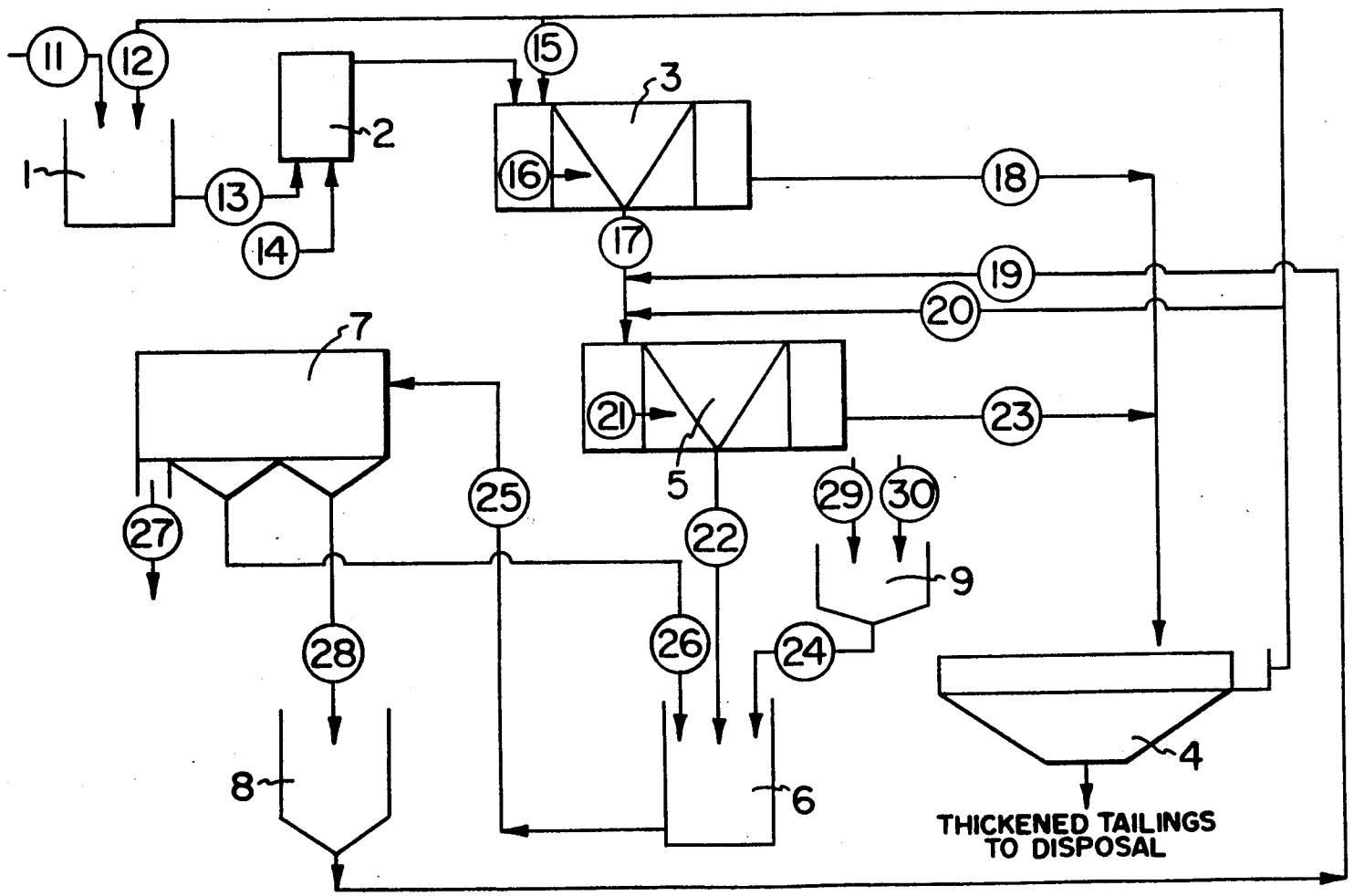
FIG. 3 CONCEPTUAL OIL AGGLOMERATION WITH $Fe^{++}$ ADDITION

INCORPORATION OF A COPROCESSING ADDITIVE INTO COAL/OIL AGGLOMERATES

This invention relates to a method of incorporating a coprocessing additive in coal/oil agglomerates.

One method of coprocessing coal and heavy oil or bitumen uses iron sulphate ($FeSo_4$ $7H_2O$) as a catalyst precursor which, upon decomposition to elemental iron and subsequent transformation to pyrite/pyrotite, assists hydrogenation of the slurry and suppresses coke formation. For high process performance the iron sulphate should be dispersed as finely as possible throughout the reactant mixture.

To reduce the amount of unreactive solids in the coprocessing reactor it is desirable that the coal be beneficiated. One way to achieve this goal is disclosed in U.S. Pat. No. 4,448,585, J. S. Yoo, and in U.S. Pat. No. 4,889,538, dated Dec. 26, 1989, J. A. Mikhlin et al where oil agglomeration is used. The oil may be a fraction produced by coprocessing. The beneficial coal and bitumen are then mixed in a ratio of about 1:2 to form the coprocessing feed slurry; normally this mixture contains at $FE^{11}$ concentration of about 0.3 w/w %.

While the processes taught by J. E. Yoo and J. A. Mikhlin et al are useful there is a need for a process wherein the total amount of required additive can be introduced into the beneficiated coal product in order to achieve fine dissemination and homogeneous distribution of the additive in the coal, before it is mixed with the bitumen. This will ensure better dispersion of the additive in the final coal/bitumen mixture.

According to the present invention there is provided a method of incorporating a coprocessing additive in coal/oil agglomerates, comprising:

a) forming an aqueous slurry of particulate coal, the particulate coal comprising carbonaceous particles and particulate inorganic material, b) agitating the slurry while admixing agglomerating oil therewith, to form carbonaceous particle/oil agglomerates with particulate inorganic material and water separated therefrom, c) separating, in an undried condition, the carbonaceous particle/oil agglomerates from the particulate inorganic material and water, and d) intimately contacting in a wash step the separated, undried, agglomerates with an aqueous solution of coprocessing additive comprising at least one water soluble salt from Groups 5 to 12 of the Periodic Table of Elements (International Union of Pure and Applied Chemistry, 1983) for adsorption of additive, in a molecularly disseminated form, by the separated, undried agglomerates.

Preferably, the coprocessing additive is at least one soluble salt of at least one substance selected from the group consisting of cobalt, molybdenum, iron, tin, nickel and mixtures thereof.

The undried carbonaceous particle/oil agglomerates may be separated from the particulate inorganic material and water by flotation/separation.

The separated, undried agglomerates may be contacted with the aqueous solution of the coprocessing additive by being contacted with a wash thereof.

The undried agglomerates with adsorbed coprocessing additive may then be centrifugally separated from the remainder of the wash, while any remaining unadsorbed coprocessing additive, separated from the agglomerates, may be recirculated with the wash liquor.

In the accompanying drawings, which show the results of tests to verify the present invention, FIG. 1 is a graph of adsorption plotted, for unit adsorption of iron by carbonaceous particle/oil agglomerates, versus equilibrium iron concentration in an aqueous supernatant liquor, FIG. 2 is a graph showing the weight of iron adsorbed by the carbonaceous particle/oil agglomerates plotted against the amount of additive used in each test, and FIG. 3 is a flow diagram of a conceptual design for a method of incorporating a coprocessing additive based on the test data.

In tests to verify the present invention, measurements were made of $FE^{II}$ adsorption from aqueous solution. From this data concentrations of the contact solutions of additive required to achieve the desired $Fe^{II}$ loading on coal agglomerates were determined. Test work was also carried out to determine the best point of addition for the $FeSO_4 \cdot 7H_2O$ solutions.

Analytical Method

All iron determinations were made by standard titration techniques as described in "Quantitative Inorganic Analysis" by Arthur I. Vogel, third addition, p. 310. When determining the iron content of coal or treated agglomerates it was first necessary to ash the solids. The ash was extracted with HCl and all the soluble iron reduced to $FE^{II}$ using a stannous chloride solution. The iron content could then be determined by the standard titration. Blank determinations for iron content, in the absence of additive, were also made on the original coal and on agglomerates prepared with the various oils used as bridging liquids.

Adsorption Experiments

Samples of carbonaceous particle oil agglomerates were prepared in a conventional manner (−60 mesh Battle River coal with heavy gas oil (HGO) as the agglomerating agent). Two levels of heavy gas oil, namely 8 cc and 10 cc, were used with 75 g. coal. In a preliminary adsorption test it was determined that equilibrium was established in less than ten minutes. Approximately 70 g of a standard solution (10 g/L) of commercial grade $FeSO_4 \cdot 7H_2O$ was placed into a number of 100 ml jars with lined caps. To each jar was added a different amount of wet, agglomerated coal product (2-20 g). The jars and contents were shaken for 30 min. and allowed to stand for another 30 min. to allow the solids to settle. A sample of the supernatant liquid was then removed by pipetting through a fibre glass filter.

The supernatant samples were analysed for $Fe^{II}$ and the results compared to the concentration of the original solution. This allowed the amount of iron adsorbed by the agglomerates to be determined. Moisture content originally present in the agglomerates was presumed to become part of the adsorbate solution for calculation purposes. If this assumption is not correct a maximum error of 2% in the calculated amount adsorbed is possible.

In FIG. 1, the adsorption isotherms are plotted for unit adsorption of iron versus equilibrium iron concentration in the supernatant liquor. It is apparent from this data that the degree of iron adsorption was adversely affected by an increase in the amount of agglomerating oil. However, it is obvious that there was a strong specific adsorption of iron by the agglomerates even in the presence of oil. The drop-off in adsorption at higher equilibrium concentrations of iron sulphate could have been caused by increased competition from hydrogen ions at the lower pHs observed in this region. Complete adsorption data are listed in Tables I and II.

TABLE I

Adsorption Data

Agglomerate Conditions and Analysis

| | |
|---|---|
| Expt. # | 686 |
| Volatiles (w/w %) | 32.7 |
| Ash (wb) (w/w %) | 6.4 |
| Ash (db) (w/w %) | 9.5 |
| Fe in stock solution | 2.21 g/L |
| Oil Type | HGO |
| Oil Volume | 8 cc |
| Coal | 75 g |

| Wt. Wet Aggs. Added (g) | Wt. Stock Soln. Added (g) | Cor-rected* Super-natant (g) | Measured $Fe^{II}$ in Super-natant (g/L) | Total Wt. $Fe^{II}$ Adsorbed (g) | $Fe^{II}$ adsorbed/g wet agglomerates (g/g) |
|---|---|---|---|---|---|
| 1.85 | 70.32 | 70.93 | 1.87 | 0.0155 | 0.0084 |
| 2.01 | 69.84 | 70.49 | 1.95 | 0.0163 | 0.0081 |
| 3.99 | 70.46 | 71.76 | 1.62 | 0.0392 | 0.0098 |
| 5.95 | 72.89 | 74.84 | 1.37 | 0.0584 | 0.0098 |
| 7.98 | 72.68 | 75.29 | 1.12 | 0.0762 | 0.0095 |
| 10.00 | 71.62 | 74.89 | 0.92 | 0.0890 | 0.0089 |
| 15.93 | 70.24 | 75.45 | 0.36 | 0.1275 | 0.0080 |

*Assumes all volatiles are moisture and migrate into supernatant liquor.
HGO = Heavy gas oil fraction from co-processing.

TABLE II

Adsorption Data

TABLE II-continued

Agglomerate Conditions and Analysis

| | |
|---|---|
| Expt. # | 689 |
| Volatiles (w/w %) | 33.2 |
| Ash (wb) (w/w %) | 6.2 |
| Ash (db) (w/w %) | 9.3 |
| Fe in stock solution | 2.01 g/L |
| Oil Type | HGO |
| Oil Volume | 10 cc |
| Coal | 75 g |

| Wt. Wet Aggs. Added (g) | Wt. Stock Soln. Added (g) | Cor-rected Super-natant (g) | Measured $Fe^{II}$ in Super-natant (g/L) | Total Wt. $Fe^{II}$ Adsorbed (g) | $Fe^{II}$ adsorbed/g wet agglomerates (g/g) |
|---|---|---|---|---|---|
| 6.08 | 71.04 | 73.06 | 1.31 | 0.0469 | 0.0077 |
| 9.77 | 70.09 | 73.33 | 0.82 | 0.0805 | 0.0082 |
| 13.99 | 69.60 | 74.24 | 0.45 | 0.1067 | 0.0076 |
| 20.08 | 71.56 | 78.23 | 0.25 | 0.1242 | 0.0062 |

Analysis of Treated Agglomerates

In a series of tests iron sulphate was added at different points in the agglomeration circuit. Product (agglomerates) and tailing fractions (particulate inorganic material in water) were analyzed for ash and iron as required. Mass and ash balances were determined for selected tests. Iron analyses are summarized in the following Table III. The amount of iron sulphate in column two is based on 150 grams of the minus −60 mesh coal, containing about 20% moisture. Oil agglomeration test results are summarized in the following Tables IV and V.

TABLE III

Addition of $FeSO_4$ To Various Stages for Agglomeration of Battle River Coal (−60 mesh sample)

| CONDITIONS | | | | | AGGLOMERATES | | Fe IN TAILINGS | | | | | |
|---|---|---|---|---|---|---|---|---|---|---|---|---|
| Expt # | Hydrate (g) | Addition Point for Hydrate | Oil Type | Vol. (cc) | Fe in Blank w/w % wb (db) | Fe Treated w/w % wb (db) | $T_{1(s)}$ w/w % (db) | $T_{1(l)}$ g/L | $T_{2(s)}$ w/w % db | $T_{2(l)}$ g/L | $C^*_{(s)}$ w/w % db | $C_{(l)}$ g/L |
| Coal | Nil | NA | NA | Nil | 0.07 (0.09) | NA | NA | NA | NA | NA | NA | NA |
| 704 | Nil | NA | #4 | 8 | 0.18 (0.27) | NA | NA | NA | NA | NA | NA | NA |
| 686 | Nil | NA | HGO | 8 | 0.25 (0.37) | NA | NA | NA | NA | NA | NA | NA |
| 689 | Nil | NA | HGO | 10 | 0.21 (0.32) | NA | NA | NA | NA | NA | NA | NA |
| 730 | Nil | NA | HGO/ pitch | 8 | 0.21 (0.31) | NA | NA | NA | NA | NA | NA | NA |
| 677 | 1.6 | 1 | #4 | 8 | 0.18 (0.28) | 0.36 (0.64) | ND | ND | ND | ND | ND | ND |
| 678 | 4.8 | 1 | HGO | 8 | 0.25 (0.37) | 0.71 (1.14) | 1.2 (14.2)** | ? | 1.4 (15.9)** | <0.001 | 0.3 (24.7)** | ? |
| 683 | 1.6 | 3 | #4 | 8 | 0.18 (0.28) | 0.44 (0.64) | NA | NA | NA | NA | — | <0.001 |
| 684 | 4.8 | 3 | #4 | 8 | 0.18 (0.28) | 0.80 (1.21) | NA | NA | NA | NA | — | 0.125 |
| 685 | 1.6 | 2 | #4 | 8 | 0.18 (0.28) | 0.36 (0.53) | ? | ? | — | — | — | — |
| 687 | 1.6 | 3 | HGO | 8 | 0.25 (0.37) | 0.40 (0.58) | NA | NA | NA | NA | — | — |
| 688 | 1.6 | 3 | HGO | 10 | 0.21 (0.32) | 0.38 (0.56) | NA | NA | NA | NA | — | — |
| 702 | 3.9 | 3 | HGO | 8 | 0.25 (0.37) | 0.75 (1.08) | NA | NA | NA | NA | NS | 0.160 |
| 703 | 5.8 | 3 | HGO | 8 | 0.25 (0.37) | 0.90 (1.30) | NA | NA | NA | NA | NS | 0.466 |
| 732 | 3.9 | 3 | HGO/ pitch | 8 | 0.21 (0.31) | 0.75 (1.08) | NA | NA | NA | NA | NS | 0.151 |
| 733 | 5.8 | 3 | HGO/ pitch | 8 | 0.21 (0.31) | 0.82 (1.17) | NA | NA | NA | NA | NS | 0.595 |

*C = centrate, subscripts s & l refer to solids and liquids respectively.
NA = not applicable, ND = not determined, NS = negligible solids.
**Ash content (w/w %) of dried solids in tails
? Indeterminate end point
— no sample
1. During initial agglomeration
2. After agglomeration but before washing
3. To product before centrifuge

TABLE IV

Blank Tests for Coal Agglomeration with No Additive
Coal - Crushed to −60 Mesh Topsize
Floc Flotation Separation at 10% solids content - washed Product Qualities | Tailings TABLE IV-continued

| % Oil (db feed) | % Oil (db prod) | Type of Oil | $FeSO_4.7H_2O$ (g) | % Ash (db prod) | % Total Moisture | Mass Yield (%) | Comb. Rec. (%) | % Fe wb (db) | Qualities % Ash (db) | Qualities Ash Rej (%) | Calc. Feed Ash (%) |
|---|---|---|---|---|---|---|---|---|---|---|---|
| 5.39 | 5.87 | No. 4 | 0.00 | 8.21 | 29.15 | 91.84 | 97.16 | 0.18 (0.27) | 69.81 | 43.45 | 13.24 |
| 5.37 | 6.24 | H.G.O | 0.00 | 9.35 | 24.14 | 86.06 | 90.52 | 0.25 (0.37) | 41.40 | 43.01 | 13.82 |
| 6.49 | 7.44 | H.G.O | 0.00 | 9.48 | 21.11 | 87.13 | 91.14 | 0.21 (0.32) | 40.42 | 39.85 | 13.46 |
| 5.40 | 5.88 | Blend | 0.00 | 9.79 | 25.14 | 91.90 | 96.50 | 0.21 (0.31) | 62.94 | 36.67 | 14.09 |

TABLE V

Addition of Ferrous Sulphate at Various Stages of Agglomeration
Coal - Crushed to −60 Mesh Topsize
Floc Flotation Separation at 10% solids content - washed

| | % Oil (db feed) | % Oil (db prod) | Type of Oil | $FeSO_4.7H_2O$ (g) | Product Qualities % Ash (db prod) | Product Qualities % Total Moisture | Product Qualities Mass Yield (%) | Product Qualities Comb. Rec. (%) | Product Qualities % Fe wb (db) | Tailings Qualities % Ash (db) | Tailings Qualities Ash Rej (%) | Calc. Feed Ash (%) |
|---|---|---|---|---|---|---|---|---|---|---|---|---|
| 1 | 5.41 | 8.46 | No. 4 | 1.60 | 8.96 | 30.57 | 64.01 | 68.86 | 0.36 (0.64) | 26.77 | 65.23 | 15.37 |
| 1 | 5.76 | 14.16 | H.G.O. | 4.80 | 13.67 | 41.73 | 40.69 | 41.91 | 0.71 (1.14) | 17.90 | 75.06 | 16.18 |
| 2 | 5.23 | 5.95 | No. 4 | 1.60 | 9.06 | 27.36 | 87.83 | 93.60 | 0.36 (0.53) | 55.10 | 46.58 | 14.66 |
| 3 | 5.40 | 5.93 | No. 4 | 1.60 | 8.90 | 27.14 | 90.98 | 96.66 | 0.44 (0.64) | 68.24 | 43.63 | 14.25 |
| 3 | 5.22 | 5.74 | No. 4 | 4.80 | 9.32 | 25.48 | 90.84 | 96.26 | 0.80 (1.21) | 65.11 | 41.84 | 14.43 |
| 3 | 5.37 | 6.24 | H.G.O. | 1.60 | 9.35 | 24.14 | 86.06 | 90.52 | 0.40 (0.58) | 41.40 | 43.01 | 13.82 |
| 3 | 6.49 | 7.44 | H.G.O. | 1.60 | 9.48 | 21.11 | 87.13 | 91.14 | 0.38 (0.56) | 40.42 | 39.85 | 13.46 |
| 3 | 5.32 | 6.10 | H.G.O. | 3.90 | 10.36 | 22.65 | 87.30 | 91.42 | 0.75 (1.08) | 42.17 | 38.40 | 14.40 |
| 3 | 5.84 | 6.73 | +H.G.O. | 3.90 | 8.99 | 22.39 | 86.82 | 91.92 | 0.75 (1.08) | 47.32 | 45.83 | 14.04 |
| 3 | 5.95 | 6.65 | +H.G.O. | 5.80 | 8.79 | 21.48 | 89.50 | 94.34 | 0.82 (1.17) | 53.33 | 42.16 | 13.47 |

1 Added to slurry before agglomeration
2 Added during wash before final separation
3 Added to final product before centrifuge
+ New H.G.O./Vacuum Bottom Blend It will be seen from Table V that adding $FeSo_4$ prior to agglomeration (examples 1) resulted in a markedly reduced carbon recovery, between 41.91 and 68.86, when compared with the addition after agglomeration, between 90.52 and 96.66.

From these tests, the best point of addition for the additive was determined to be the washed flotation cell product stream, obtained from a rougher-cleaner flotation circuit arrangement, before it was fed to the centrifuge. For a given, desired iron adsorption the necessary concentration of $FeSo_4 \cdot 7H_2O$ in the wash liquor can be estimated from the adsorption curves. The desired level of iron adsorption (g $Fe^{II}$/g wet agglomerate) is selected on the ordinate axis on FIG. 1. (If the coal already contains iron then the adsorption requirement is reduced accordingly). A horizontal line is then drawn from the selected point on the axis to intersect the appropriate adsorption curve. From this intercept a vertical line is dropped to determine the corresponding equilibrium concentration of $Fe^{II}$. Provided that the amount of agglomerated coal and the Volume of wash are known then the adsorption level and equilibrium concentration can be used to calculate the required concentration of $Fe^{II}$ in the original contact solution. FIG. 1 illustrates the construction required to determine the equilibrium concentrations for two levels of adsorption. The arrow heads indicate the measured adsorption achieved compared to the selected values. The close agreement between the calculated and measured iron adsorption for the agglomeration tests indicated that adequate time for adsorption was provided during the five minute wash period. Neither adsorption nor wash times were optimised. A clean centrate was produced having flow solids content, which could be reused, allowing any additive remaining in solution to be recycled.

Where the additive was applied in the early stages of coal beneficiation, agglomeration was poor and coal losses to the tailings was heavy In these cases additive losses to the tailings were proportional to the coal losses, with unit adsorption of iron by tailings solids being about the same as that for the coal agglomerates themselves, (see test 678 in Table III). These results also showed the tailings to have a similar ash content to the original coal, i.e. selectivity was poor.

FIG. 2 shows that the weight of iron adsorbed was roughly proportional to the amount of additive used in each test. In these results the total amount of iron present in each sample was corrected for the blank iron content of the coal and agglomerating oil. Adsorption of iron by the agglomerates was greatest when the more refined #4 oil was used as the bridging oil. The use of HGO and HGO/pitch mixtures (75:25) during beneficiation, caused a reduction in iron adsorption by the coal agglomerates in both cases. However, there was no significant difference observed in the results obtained with the two different oils.

FIG. 3 is a schematic diagram of an agglomeration process using the present invention.

In FIG. 3, there is shown a raw coal feed and dilution water mixing device 1, a high shear mixer 2. a primary flotation/separation device 3, a thickener 4, a secondary flotation/separation device 5, a washing device 6, a centrifugal separator (7), a water collector 8, and a mixing device 9.

In FIG. 3, the raw coal feed stream identified by number (11) is desiqnated by the same number in the following Table VI the other streams are designated in the same manner in FIG. 3 and the Table VI.

TABLE VI

Plant Design Flows

| Stream Number | 11 | 12 | 13 | 14 | 15 | 16 | 17 |
|---|---|---|---|---|---|---|---|
| STREAM NAME | Raw Coal Feed | Dilution Water | High Shear Feed | Oil to High Shear | Dilution Water | Primary Rougher Flotation Circuit Feed | Primary Rougher Flotation Product |
| Liquid Flow | | | | | | | |
| USGPM | | 629.41 | 741.18 | 10.77 | 903.92 | 1650.43 | 589.83 |
| $FT^3$/MIN | | 84.13 | 99.08 | 1.44 | 120.83 | 220.62 | 78.84 |
| Short Tons/HR | | 157.50 | 202.5 | 2.63 | 226.19 | 431.33 | 162.38 |
| Density (LB/$FT^3$ | 88.17 | 62.40 | 68.13 | 60.96 | 62.4 | 65.17 | 68.65 |
| Solids Conc (WT %) | 90.0 | | 20.0 | | | 10.0 | 25.0 |
| Total Solids | | | | | | | |
| Short Tons/HR | 40.5 | | 40.5 | | | 43.13 | 40.60 |
| LB/MIN | 1350.0 | | 1350.00 | | | 1437.75 | 1353.16 |
| Coal (LB/MIN) | 1170.86 | | 1170.86 | | | 1170.86 | 1142.67 |
| Ash (LB/MIN) | 179.15 | | 179.15 | | | 179.15 | 124.85 |
| Water (LB/MIN) | 150.00 | 5250.0 | 5400.0 | | 7534.75 | 12,939.75 | 4059.48 |
| Reagents (LB/MIN) | | | | | | | |
| Oil (LB/MIN) | | | | 87.75 | | 87.75 | 85.64 |

| Stream Number | 18 | 19 | 20 | 21 | 22 | 23 |
|---|---|---|---|---|---|---|
| STREAM NAME | Primary Rougher Flotation Tails | Dilution Water from Centrifuge Centrate | Dilution Water from Settler | Secondary Cleaner Flotation Cell Feed | Secondary Cleaner Flotation Product | Secondary Cleaner Flotation Tailings |
| Liquid Flow | | | | | | |
| USGPM | 1066.06 | 472.53 | 501.09 | 1559.98 | 580.91 | 982.34 |
| $FT^3$/MIN | 142.50 | 63.16 | 66.98 | 208.53 | 77.65 | 131.31 |
| Short Tons/HR | 268.95 | 118.36 | 125.39 | 406.13 | 159.76 | 246.37 |
| Density (LB/$FT^3$ | 62.91 | 62.46 | 62.4 | 64.92 | 68.58 | 62.54 |
| Solids Conc (WT %) | 0.94 | | | 10.0 | 25.0 | 0.27 |
| Total Solids | | | | | | |
| Short Tons/HR | 2.54 | | | 40.61 | 39.94 | 0.67 |
| LB/MIN | 84.59 | | | 1353.75 | 1331.33 | 22.42 |
| Coal (LB/MIN) | 28.19 | | | 1142.67 | 1133.66 | 9.01 |
| Ash (LB/MIN) | 54.30 | | | 124.85 | 112.12 | 12.73 |
| Water (LB/MIN) | 8880.27 | 3944.65 | | 12,183.75 | 3993.99 | 8189.76 |
| Reagents (LB/MIN) | | 0.59 | | 0.59 | 0.59 | 0 |
| Oil (LB/MIN) | 2.11 | | | 85.64 | 84.96 | 0.68 |

| Stream Number | 24 | 25 | 26 | 27 | 28 | 29 | 30 |
|---|---|---|---|---|---|---|---|
| STREAM NAME | $Fe^{II}$ Solution Addition | Centrifuge Feed | Centrifuge Screen Recycle | Centrifuge Product | Centrifuge Centrate | $FeSO_4$ $7H_2O$ (g) | $Fe^{II}$ Solution Make-up Water |
| Liquid Flow | | | | | | | |
| USGPM | 40.50 | 652.30 | 31.07 | | 472.25 | | 47.48 |
| $FT^3$/MIN | 5.41 | 87.19 | 4.15 | | 63.13 | | 6.35 |
| Short Tons/HR | 12.25 | 180.60 | 8.60 | | 110.29 | | 11.88 |
| Density (LB/$FT^3$ | 75.46 | 69.04 | 69.03 | 45.05 | 62.46 | 71.06 | 62.4 |
| Solids Conc (WT %) | | 23.43 | 23.43 | 75.0 | | | |
| Total Solids | | | | | | | |
| Short Tons/HR | | 42.31 | 2.01 | 40.30 | 0 | | |
| LB/MIN | | 1410.36 | 67.16 | 1343.20 | 0 | | |
| Coal (LB/MIN) | | 1190.34 | 56.68 | 1133.66 | | | |
| Ash (LB/MIN) | | 117.73 | 5.61 | 112.12 | | | |
| Water (LB/MIN) | | 4609.50 | 219.5 | 447.73 | | | 396.01 |
| Reagents (LB/MIN) | 12.46 | 13.08 | 0.62 | 12.46 | 0.59 | 62.03 | |
| Oil (LB/MIN) | | 89.21 | 4.25 | 84.96 | | | |

In operation raw coal feed (11) and dilution water (12) are slurried in the mixing device 1, and the slurry is fed as feed (13) to the high shear mixer 2, together with agglomeration oil (14). Carbonaceous particle/oil agglomerates formed in the high shear mixer 2, together with the particulate inorganic material (ash), and water, separated therefrom, are fed to the primary flotation/separation device 3 where, prior to aeration/flotation, dilution water (16) is added. The primary flotation/separation device 3 separates the agglomerates from the remainder to give a primary rougher, undried agglomerate flotation product (17), which is fed to a secondary flotation/separation device 5, and primary rougher flotation tails (18), comprising particulate inorganic material and water, are fed to a thickener 4. The tails (18) are thickened (dewatered) in the thickener 4 for disposal, and the water from the thickener is used as a source for the dilution waters (12) and (15) and is also fed to the secondary flotation/separation device 5 as dilution water (20) for the agglomerate flotation product fed thereto.

The relatively clean, flotated, undried agglomeration product (22) from the secondary flotation/separation device 5 is fed to the washing device 6 together with an $Fe^{II}$ aqueous solution (24) from the mixing device 9. The mixing device 9 is fed with a feed (29) of $FeSO_4 \cdot 7H_2O$ and a feed (30) of $Fe^{II}$ solution make-up water.

The undried agglomerates adsorb $Fe^{II}$ in the washing device 6.

A feed (25), comprising undried agglomerates, having adsorbed $Fe^{II}$, and wash water is fed from the washing device 6 to the centrifugal separator 7 from which the undried agglomerates with adsorbed $Fe^{II}$, exit as product (27), while a centrifuge, screened recycle, comprising $FeSo_4$ and water, is fed back as a feed (26) to the washing device 6, and water as a centrifuge centrate is fed to the collector 8 to be used as dilution water (19) for the secondary flotation/separation device 5. Before admixing with bitumen or heavy oil for co-processing the product (27) must be treated to lower the water content.

The rougher-cleaner flotation circuit is one in which the primary flotation product is reslurried with process water and fed to a second flotation cell, where further beneficiation occurs and a lower ash, secondary flotation product is collected. The secondary flotation product is agitated in an aqueous solution of iron sulphate for 5 minutes to allow adsorption of iron, and then centrifuged to remove the product containing the adsorbed additive. Clear centrifuge centrate, containing a residual amount of 0.15 g $FE^{II}$/L is recycled as dilution water for the cleaner flotation cell feed. The $Fe^{II}$ in this recycle stream will eventually equilibrate to some constant, low level. Table VI shows plant design flows for a 40 TPH plant incorporating $FE^{II}$ addition, prior to centrifuging.

Mass Balance Tests

Having determined that the best agglomeration results were obtained by adding the $FeSO_4$ hydrate to the agglomerate wash stage immediately before the centrifuge, some mass balance tests were carried out to determine the distribution of additive in the various process streams. In these cases the total amount of centrifuge wet product and centrate were carefully collected and weighed. Each fraction was then analysed for $Fe^{II}$ using the standard method. The iron content of the blank, untreated agglomerates was also considered. In these tests the centrate was very clean with only a minimal amount of solids visible; the centrate liquor was analysed only for iron content, the solids present being considered negligible. These results are summarised in the following Table VII.

TABLE VII

| | Mass Balance Calculations | | | |
|---|---|---|---|---|
| Expt. # | 702 | 703 | 732 | 733 |
| BALANCE IN: | | | | |
| $Fe^{II}$ in additive (g) | 0.84 | 1.25 | 0.84 | 1.25 |
| $Fe^{II}$ in coal & oil (g) | 0.37 | 0.36 | 0.33 | 0.34 |

TABLE VII-continued

| | Mass Balance Calculations | | | |
|---|---|---|---|---|
| Expt. # | 702 | 703 | 732 | 733 |
| Total (g) | 1.21 | 1.61 | 1.17 | 1.59 |
| BALANCE OUT: | | | | |
| $Fe^{II}$ in centrate (g) | 0.05 | 0.20 | 0.07 | 0.30 |
| $FE^{II}$ in wet product (g) | 1.13 | 1.36 | 1.19 | 1.31 |
| Total | 1.18 (−2.5%) | 1.56 (−3.4%) | 1.26 (+7.5%) | 1.61 (+1.6%) |

Adsorption measurements from the tests show that Battle River coal has a strong, specific adsorption capacity for $Fe^{II}$. Addition of increasing amounts of oil for agglomeration reduces this adsorption capacity, as does reducing the degree of refinement of the oil (i.e. going from #4 to coprocessing derived heavy gas oil). However, this loss of adsorption capacity is not large enough to prevent adequate dosing of the coal with additive.

The point of addition of the additive in the agglomeration circuit is very important. If introduced during initial mixing, prior to agglomeration, tests show that the presence of the additive results in disruption of the agglomeration process with consequent loss in both quantity and quality of product. In this situation the additive becomes distributed among the various process streams in proportion to the coal content of each stream.

It has been found advantageous according to the present invention to introduce the additive to the wash immediately before the centrifuge. This allows adequate time for adsorption of $Fe^{II}$ and limits losses of additive to only one stream, the centrate. Because the centrate is quite clean with respect to solids, it would be a simple matter to recycle this stream for use as the final wash after introducing sufficient additive to bring its concentration back to the appropriate level. The additive concentration in the wash solution, required to achieve the desired additive loading, can be calculated from the adsorption curves.

Determination of Relative Adsorption of $Fe^{II}$ and $SO_4^{2-}$ Battle Creek Coal Agglomerates It was of interest to determine whether $FE^{II}$ adsorption by coal agglomerates during loading with $FeSO_4$ solution, occurred by an ion exchange mechanism. Table VIII outlines the analytical results for Fe and S contents of different samples along with the corresponding estimates of the amounts adsorbed.

TABLE VIII

| Coal Sample | $Fe_{(Total)}$ (w/w %) | $Fe_{(EXTRACTABLE)}$ HCl (w/w %) | $Fe_{(EXTRACTABLE)}$ $H_2O$ (w/w %) | $Fe_{(ADSORBED)}$ (w/w %) | $S_{(Total)}$ (w/w %) | $S_{(ADSORBED)}$ |
|---|---|---|---|---|---|---|
| Raw Coal (−60 mesh) | 0.09 | NA | NA | NA | 0.42 | NA |
| Agglomerated, Unloaded Coal | 0.35 | NA | NA | NA | 0.52* | NA |
| Raw, Loaded+ Coal (−200 mesh) | 7.62 | 7.19 | 2.92 | 7.55 | 4.69 | 4.29 |
| Agglomerated, Loaded Coal | 1.26 | 0.84 | <0.01 | 0.91 | 0.79 | 0.27 |

*estimated from sulphur content of coal and oil.
NA = not applicable.
+prepared by mixing an $FeSO_4$ solution with unagglomerated coal and then evaporating to dryness.

Table VIII: Analyses for Sulphur and Iron and Estimates of Amounts Adsorbed

Adsorbed quantities were determined by difference between the total elemental content and the amount present in the corresponding blank sample.

Samples with adsorbed iron were extracted with dilute hydrochloric acid or distilled water. The analytical data show that an acidic wash displaces virtually all the iron from both raw, loaded coal and the loaded, agglomerated coal. On the other hand, extraction with water removes virtually no iron from the loaded agglomerated coal, whereas a significant amount of iron from the raw, loaded coal is extracted.

These results indicate that $Fe^{II}$ was chemically adsorbed on ion exchange sites present in the coal matrix. In the case of the raw, loaded coal it appears that the ion exchange capacity of the coal was exceeded as a result of the large amount of additive used. The excess additive (not ion exchanged) is only physically adsorbed and can be readily removed by extraction with water.

In $FeSO_4$ the ratio of iron to sulphur has a value of 1:1.75. If this Fe:S ratio is calculated for the raw, loaded coal and agglomerated, loaded coal, using the Fe adsorbed and S adsorbed data from Table VIII, then values of 1:1.76 and 1:3.37 respectively are obtained. The ratio for the raw, loaded coal is almost identifical to the theoretical value. This is to be expected where $FeSO_4$ solution is added to dry coal, mechanically mixed and dried, leaving no opportunity for selectivity. For the agglomerated, loaded coal the ratio is 1:3.37, indicating a preferential adsorption of FeII compared to sulphate ions from the suspending liquid containing dissolved $FeSO_4$. Any residual sulphate ions remaining with the agglomerated coal is probably associated with the residual liquor remaining with the coal after centrifuging.

Coprocessing tests were conducted in which coal, loaded with additive, by adsorption or simple mixing, were compared. It was found that, under the same processing conditions, the sample with adsorbed $Fe^{II}$ produced about 50% less coke than that sample in which the $Fe^{II}$ was simply admixed to the coal. Decreased coke production allows higher coprocessing temperatures to be used, resulting in higher yields of liquid products.

It will be appreciated that, for ease of processing, the agglomerates having the additive intimately contacted therewith according to the present invention need to be dried before being blended with hot heavy oil to form a feed for a coprocessing reactor. However, for ease of storage, it may be desirable to leave the agglomerates, with the additive intimately in contact therewith, in the undried condition.

We claim:

1. A method of incorporating a coprocessing additive in coal/oil agglomerates, comprising:

a) forming an aqueous slurry of particulate subbituminous coal, the particulate coal comprising carbonaceous particles and particulate inorganic material, b) agitating the slurry while admixing agglomerating oil therewith, to form carbonaceous particle/oil agglomerates with particulate inorganic material, and water, separated therefrom, c) separating, in an undried condition, the carbonaceous particle/oil agglomerates from the particulate inorganic material and water, and d) intimately contacting the separated, undried, agglomerates with an aqueous solution of coprocessing additive comprising at least one water soluble salt of a metal from Groups 5 to 12 of the Periodic Table of Elements (International Union of Pure and Applied Chemistry, 1983) for specific adsorption of additive in molecularly disseminated form by the separated, undried agglomerates.

2. A method according to claim 1, wherein the coprocessing additive is at least one soluble salt of at least one substance selected from the group consisting of cobalt, molybdenum, iron, tin, nickel and mixtures thereof.

3. A process according to claim 1, wherein the undried carbonaceous particle/oil agglomerates are separated from the particulate inorganic material and water by flotation/separation.

4. A process according to claim 1, wherein the separated, undried agglomerates are contacted with the aqueous solution of the coprocessing additive by being washed with a wash thereof.

5. A process according to claim 4, wherein the undried agglomerates with adsorbed coprocessing additive are centrifugally separated from the remainder of the wash, and any remaining coprocessing additive separated from the agglomerates is recirculated to the wash stream.

6. A method according to claim 2 wherein the salt is a sulphate.

7. A method according to claim 6 wherein the salt is iron sulphate.

* * * * *